US008316685B2

(12) United States Patent
Stucki et al.

(10) Patent No.: US 8,316,685 B2
(45) Date of Patent: Nov. 27, 2012

(54) ROLLER HOLDING UNIT

(75) Inventors: Andreas Stucki, Gelterkinden (CH); Beat Schweizer, Titterten (CH)

(73) Assignee: Von Arx AG, Sissach (CH)

( * ) Notice: Subject to any disclaimer, the term of this patent is extended or adjusted under 35 U.S.C. 154(b) by 520 days.

(21) Appl. No.: 12/587,226

(22) Filed: Oct. 2, 2009

(65) Prior Publication Data

US 2010/0095738 A1 Apr. 22, 2010

(30) Foreign Application Priority Data

Oct. 3, 2008 (CH) ..... 01571/08

(51) Int. Cl.
*B21D 41/04* (2006.01)
*B21D 37/12* (2006.01)
*B21D 39/04* (2006.01)

(52) U.S. Cl. ..... 72/452.8; 72/407; 72/409.16; 72/416; 72/453.16; 81/301; 81/342; 81/345

(58) Field of Classification Search ..... 72/409.01, 72/409.16, 407, 413, 416, 453.15, 453.16, 72/6; 30/191, 192, 193, 228; 81/301, 342, 81/345, 383.5, 427.5
See application file for complete search history.

(56) References Cited

U.S. PATENT DOCUMENTS

| | | | | |
|---|---|---|---|---|
| 5,490,406 | A * | 2/1996 | College | 72/412 |
| 6,035,775 | A * | 3/2000 | Nghiem | 100/43 |
| 6,164,106 | A * | 12/2000 | Nghiem et al. | 72/20.1 |
| 6,240,626 | B1 * | 6/2001 | Nghiem | 29/701 |
| 6,244,085 | B1 * | 6/2001 | Dummermuth | 72/31.1 |
| 6,434,998 | B2 * | 8/2002 | Amherd | 72/416 |
| 6,510,723 | B2 | 1/2003 | Amherd | |
| 6,662,621 | B1 | 12/2003 | Amherd | |
| 6,739,172 | B2 * | 5/2004 | Wagner | 72/409.01 |
| 7,216,523 | B2 * | 5/2007 | Frenken | 72/416 |
| 7,363,799 | B2 * | 4/2008 | Hamm et al. | 72/452.8 |
| 7,434,441 | B2 * | 10/2008 | Frenken | 72/409.19 |
| 7,634,859 | B2 | 12/2009 | Amherd | |
| 7,861,798 | B2 | 1/2011 | Amherd | |
| 7,882,722 | B2 * | 2/2011 | Lefavour et al. | 72/416 |
| 8,151,703 | B2 | 4/2012 | Schweizer et al. | |
| 2006/0000072 | A1 * | 1/2006 | Frenken | 29/237 |
| 2007/0251070 | A1 | 11/2007 | Amherd | |
| 2007/0271992 | A1 | 11/2007 | Amherd | |

FOREIGN PATENT DOCUMENTS

| | | |
|---|---|---|
| DE | 196 31 019 B4 | 8/1997 |
| EP | 1 103 349 B2 | 5/2001 |
| EP | 1 684 948 B1 | 8/2006 |

* cited by examiner

*Primary Examiner* — David B Jones
(74) *Attorney, Agent, or Firm* — Pauley Petersen & Erickson

(57) ABSTRACT

A pressing tool having a drive unit, a piston-cylinder unit with a fork-like receiver and an actual clamping pincer. The clamping pincer has a T-shaped mounting which, with a retaining bolt and a retaining bolt receiver, is connected to a fork-like receiver. In the fork-like receiver, a roller holder with two rollers is located. The fork-like receiver is part of the piston-cylinder unit. On actuation of the pressing tool, the piston-cylinder unit is pulled back and thus the roller holder with the rollers is moved forward relative thereto in an axial direction towards the clamping pincer. Thus, the rollers roll on roll flanks of the clamping jaws of the clamping pincer. The clamping pincer is pressed together by the rollers pressing apart the clamping jaws at the rear. Thus, the rollers are supported on a bearing block with sliding bearing surfaces. In the region between contact surfaces of the rollers with the sliding bearing surfaces and the contact line of the two rollers, there is a dirt collection chamber.

18 Claims, 3 Drawing Sheets

ROLLER HOLDING UNIT

BACKGROUND OF THE INVENTION

1. Field of the Invention

This invention relates to a roller holding unit for a pressing tool with a piston-cylinder unit and clamping jaws.

2. Discussion of Related Art

German Patent Reference DE 196 31 019 teaches a pressing device having a pressing pincer for connecting a tube to a press fitting. The pressing pincer includes two pivot arms which are each pivotally articulated by one bolt, respectively, between two equal T-shaped carrier plates. A piston-cylinder unit is actively connected to a roller holder with two rollers. The pivot arms have at one end a roll surface for supporting on the press cylinder of the pressing device. At the opposite end they are designed as clamping jaws with pressing surfaces directed towards one another. The articulations for the bolts are located at a distance on the carrier plates. In the region of the free end of the T-shaped carrier plates, a receiver of a connection bolt is located for the connection with the pressing device. During use of this device, the pressing pincer is pulled to the rear towards the pressing device. In doing so, the pivot arms slide with their roll surfaces along the pressing device to the rear. The tensile force is transmitted via the connection bolt onto the T-shaped carrier plates. Thus, the pivot arms pivot about the bearing bolts, and the pressing jaws are moved towards one another and pressed together.

European Patent Reference EP-1,103,349 discloses a pressing tool which actuates a hydraulic piston-cylinder unit by an electrically operated hydraulic pump. The same is actively connected to a roller holder which includes two rollers. The clamping jaws are connected via a retaining bolt to a fork-like receiver by a T-shaped suspension. The fork-like receiver is part of the piston-cylinder unit. The rollers on the roller holder roll on the clamping jaws of a clamping pincer as soon as the clamping pincer is pulled rearwards by the piston-cylinder unit, and thus the clamping is carried out. In doing so, the clamping pincer is pressed together by the rollers pressing apart the clamping jaws at the rear. With this design, the roller has the shape of a yoke which is rigidly connected to the piston rod. Roller holders, rollers, and roller mountings need to be designed in a solid manner because the full pressing force and the actuation force of the piston-cylinder unit needs to be accommodated by the rollers via their mounting and transmitted to the roller holder. This design requires a corresponding constructional size and dimensioning of the retaining plates and the rollers, roller bearings, and bearing pins. It is accordingly heavy and complicated in its manufacture.

European Patent Reference EP-1 684 948 shows a roller holder unit for an electrically operated pressing tool in which a bearing block for two identical rollers is provided with sliding bearing surfaces, the form of which corresponds to the roll surface and thus to the outer diameter of the roller. This design has the disadvantage that in the area of the sliding bearing surfaces and between the rollers, dirt particles can accumulate which, after a certain time, can result in plugging, and thus seizing.

SUMMARY OF THE INVENTION

It is one object of this invention to manufacture a roller holder unit with reduced disadvantages and that is simple to manufacture, lightweight, space-saving, and reliable.

This object is solved by this invention having characteristics described in this specification and in the claims.

One advantage of this invention is that the roller holder unit according to this invention ensures the plug-free condition. This is achieved by the introduction of a dirt collection chamber with a dirt collection space influenced in form and size by the shape of the sliding bearing surface.

One advantage of this invention is to reduce plugging by a wiper.

A further advantage of this invention is that by the screw connection of the retaining plate with the bearing block in axial direction, for a two-piece design of bearing block and sliding bearing surfaces, they can be screwed together at the same time. Additional fasteners can thus be saved.

BRIEF DESCRIPTION OF THE DRAWINGS

This invention is described in connection with the drawings, wherein.

DETAILED DESCRIPTION OF THE INVENTION

Figure 1:
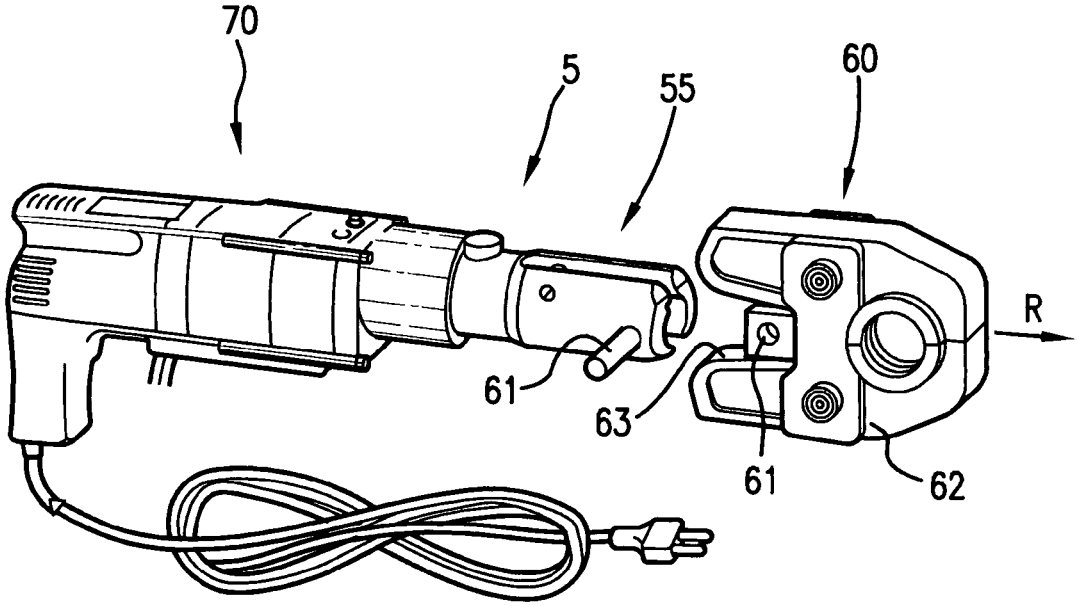
FIG. 1 shows a perspective view of a pressing pincer.

A known pressing tool is illustrated in FIG. 1, and comprises a drive unit 70, a piston-cylinder unit 5 with a fork-like receiver 55, and an actual clamping pincer 60. The clamping pincer 60 is fastened to a T-shaped mounting which is connected to the fork-like receiver 55 with a retaining bolt 61 and a retaining bolt receiver. In the fork-like receiver 55, a roller holder with two rollers is located. The fork-like receiver 55 is part of the piston-cylinder unit 5. The rollers roll on the roll flanks 63 of the clamping jaws 62 of a clamping pincer 60 as soon as the piston rod is pushed to the front. In doing so, the clamping pincer 60 is pressed together by the rollers pressing apart the clamping jaws 62 at the rear. The clamping is thus carried out.

Figure 2:
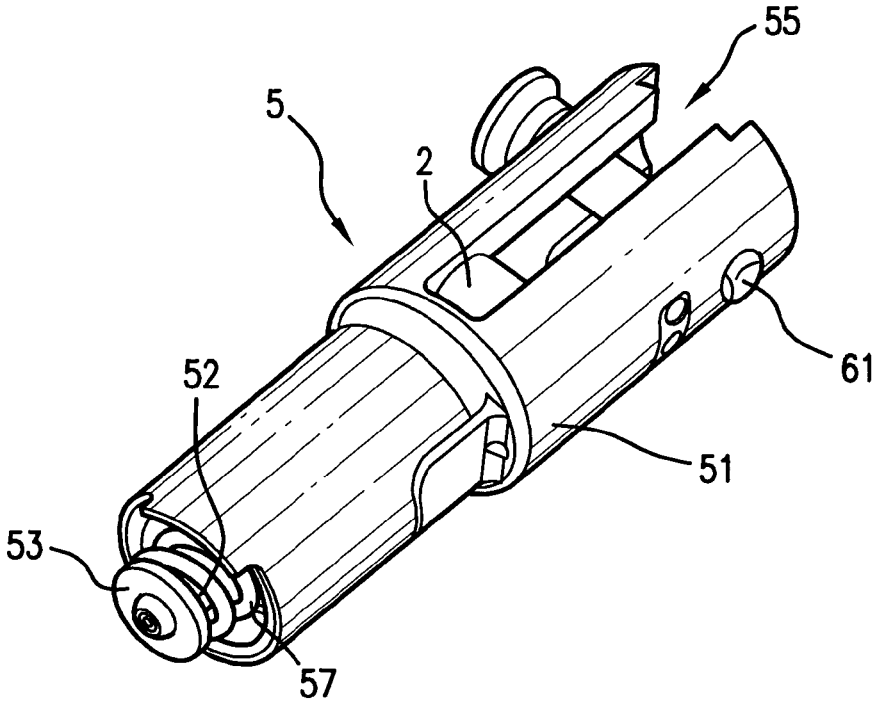
FIG. 2 shows a three-dimensional view of a piston-cylinder unit.

The connection of drive unit 70 and clamping pincer 60 is formed by the piston-cylinder unit 5. According to FIG. 2, it includes the cylinder head 51 with a through-bore for receiving a retaining bolt 54 for fastening the clamping pincer 60. In the cylinder head 51, a compression spring 57 is located which pushes the piston rod 52 to the front in a rest position. In the fork-like receiver 55, one of the rollers 2 is partly visible. When actuating the pressing tool, the piston rod 52 is pushed to the front. The cylinder head 51 remains stationary, whereby the rollers 2 are relatively moved to the front within the fork-like receiver 55. The clamping jaws 62 project slightly into the fork-like receiver 55 and abut with their roll flanks 63 against the outer side of the rollers 2. The rollers 2 thus run on the clamping jaws 62 along the roll flanks 63 pressing them outwards. The pressing is carried out in the clamping pincer 60.

Figure 3:
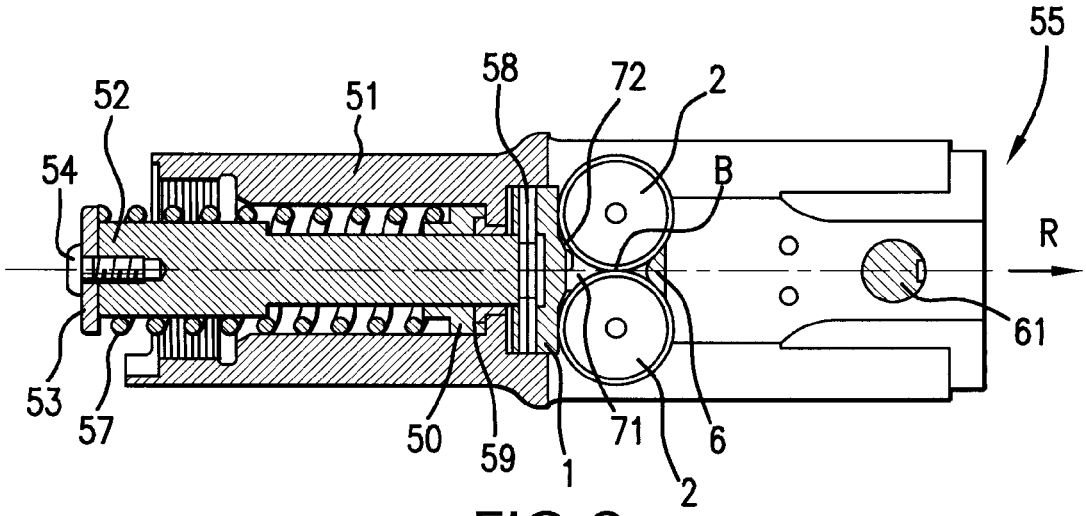
FIG. 3 shows the piston-cylinder unit in a section view with a roller holder unit.

More details of the piston-cylinder unit 5 are apparent from FIG. 3, shown in section, in connection with the roller holder unit. The piston rod 52 projects on one side into the cylinder head 51 and is biased by a compression spring 57. The compression spring 57 encompasses the piston rod 52 and abuts on one end against a spring washer 53, and on the other end, against a seal retaining ring 50. The spring washer 53 is fastened to the piston rod 52 with a screw. Between the seal retaining ring 50 and the cylinder head 51, a scraper ring 59 is arranged which is penetrated by the piston rod 52. At the head-side end of the piston rod 52, the roller holder unit is fastened and projects from the cylinder head 51 into the region of or near the fork-like receiver 55 such that two rollers 2 are partly located in the opening of the fork. A bearing block 1 of the roller holder unit is fixed on the piston rod 52 by a clamping pin 58. When on actuation of the pressing tool, the piston rod 52 is now pushed in an axial direction R to the front, wherein the cylinder head 51 and the clamping pincer 60 remain stationary, then the roller holder unit is moved forward within the fork-like receiver 55 towards the retaining bolt 54, and thus against the clamping jaws 62. The rollers 2 thus roll along the roll flanks 63 of the clamping jaws 62 and press the same apart. As soon as the pressing is completed, the piston rod 52 is moved back by the compression spring 57 into the rest position. Thus, also the roller holder unit reaches again the rest position slightly outside of the cylinder head 51.

Figure 4:
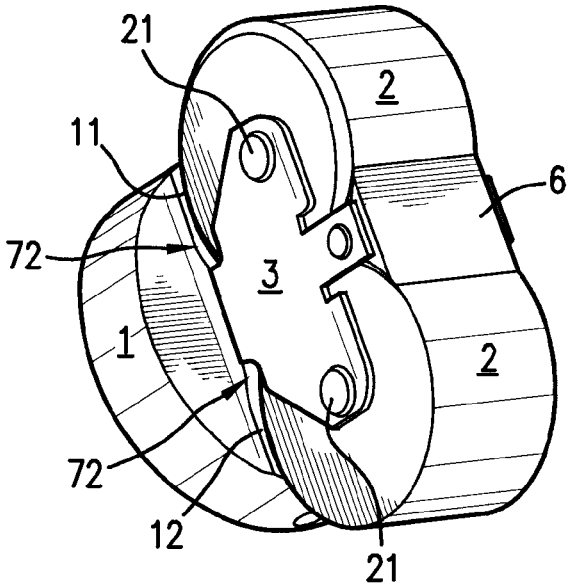
FIG. 4 shows the new roller holder unit in a three-dimensional view.
Figure 5:
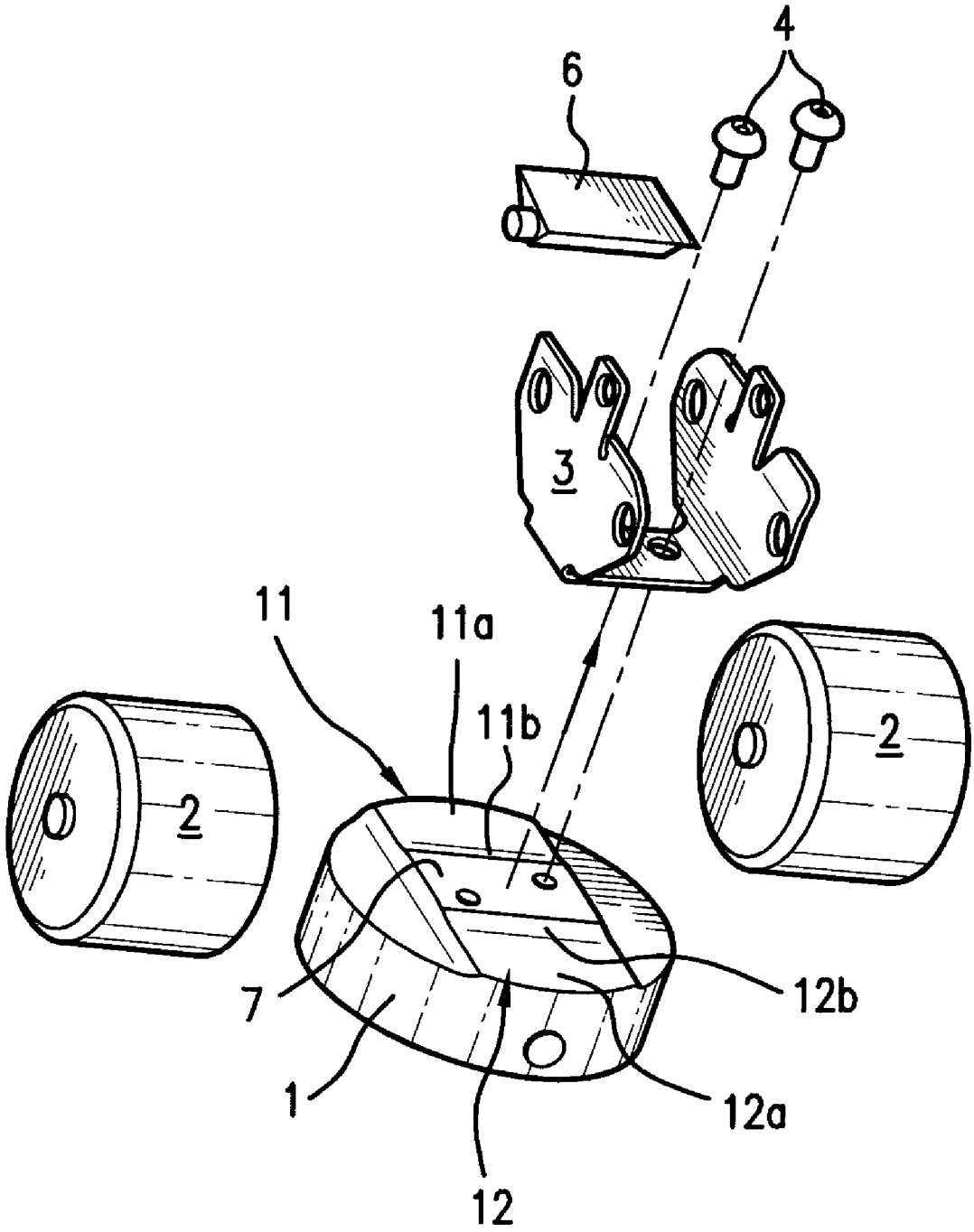
FIG. 5 shows the new roller holder unit with a bearing block in an exploded view.

The roller holder unit is shown in a three-dimensional view in FIG. 4 and includes a bearing block 1 which corresponds to a cylindrical recess in the cylinder head 51 on its outer end-face. On the bearing block 1, a retaining plate 3 is arranged perpendicularly and is fastened to the bearing block 1 by screws 4, such as shown in FIG. 5. On the retainer plate 3, two rollers 2 are present, spaced apart from one another. The rollers 2 are arranged so that they contact one another along a contact line B, such as shown in FIG. 3, on their periphery. Thus, they mutually support one another and roll on one another. They are secured from falling out by securing pins 21. Because the securing pins 21 do not have to accommodate bearing forces, they are lightly dimensioned and require no extra mounting for the rollers 2 on the securing pins 21. Even an embodiment without through-bores of the rollers 2 is possible. The geometrical arrangement and design of the clamping jaws can prevent the rollers 2 from falling out. The securing function when permitting rotational movement of the rollers 2 is also ensured, and when the inner diameter of the rollers is considerably larger than the diameter of the securing pins 21 and thus much play is present, suitable surfaces on the securing pin 21 and at the through-bores of the rollers 2 are sufficient. For example, steel rollers with securing pins 21 of bronze can be used which ensures a permanent self-lubrication. Finally, on the retaining plate 3, specifically in a region which is facing towards the retaining pin 61 during the use of the pressing tool, in addition, a dirt scraper 6 is attached.

As mentioned, the rollers 2, are mutually supported on one another and are also supported against suitable sliding bearing surfaces 11, 12 on the bearing block 1. The main load on the rollers 2 at actuating the pressing tool is generated by the pressing-apart of the roll flanks 63 of the clamping jaws 62. The direction of the load is effected via the roller surface in a straight line through the centers of the rollers 2 onto the respective other roller. The rollers 2 are thus mutually supported on one another. Thus, this load does not need to be accommodated by any mounting, and thus does not need to be accommodated and transmitted by the securing pins 21 and the retaining plates 3.

A second type of load on the rollers is effected by relative movement of the piston rod 52 and thus of the bearing block 1. This load is effected perpendicular to the bearing block 1, thus in axial direction R. For this purpose, the bearing block 1 has the sliding bearing surfaces 11, 12. The sliding bearing surfaces 11, 12 are formed into the bearing block 1. Further embodiments for a geometrical design of the sliding bearing surfaces 11, 12 are shown in FIG. 5. Here, the deepest location of the inward formation is located between the periphery, thus the outer edge, of the bearing block 1 and its center. Thus, the mentioned forces, as a matter of principle, are transmitted perpendicularly onto the sliding bearing surfaces 11, 12. So that the sliding friction of the surfaces of the rollers 2 on the sliding bearing surfaces 11, 12 does not become too large and block the actuation of the pressing tool, the nature of the surfaces of the rollers 2 and of the sliding bearing surfaces 11, 12 are matched to one another. They can be hardened, sintered, or coated. Suitable materials are, for example, a carbon nitration, a Teflon® coating of the sliding bearing surfaces, or the like. The selection of a ceramic material for the bearing block 1 and the rollers 2 of steel with hardened surfaces is also suitable. Also possible is the selection of other special material pairings. For example, a pairing of chromed steel rollers with a bearing block of nylon-6 can lead to a suitable result. Here, as a matter of fact, an additional impact damping is obtained without affecting the pressing force. Additionally, one lubrication groove 13 for each sliding bearing surface 11, 12 can be provided to serve for the supply of some lubricant as well as for the removal of possible wear debris.

Overall, this construction has significant advantages with respect to the accommodation of the occurring forces. For accommodation of the highest forces, the rollers 2 are mutually supported on one another. Their axis of rotation is not loaded and can be limited to securing the rollers 2 from falling out.

In the region between the contact surfaces of the rollers 2 with the sliding bearing surfaces 11, 12 and the contact line B of the two rollers 2, a dirt collection chamber 71, such as shown in FIG. 3, is present which at least in a region near the contact surfaces 11, 12 comprises lateral dirt discharge chambers 72. The dirt collection chamber 71 is approximately triangle-shaped while the dirt discharge chambers 72 extending sideways thereof are formed relatively flat and are in connection with the dirt collection chamber 71. The dirt collection chamber 71 as well as the dirt discharge chambers 72 can receive dirt accumulations in a manner that even after a longer period of operation no seizing occurs.

FIG. 5 shows finally the new roller holder unit with the bearing block 1 in an exploded view. In this exemplary embodiment, it is apparent that the sliding bearing surfaces 11, 12 each comprise planar surface portions 11*a*, 12*a* and raised surface portions 11*b*, 12*b*. The planar surface portions 11*a*, 12*a* are arranged here perpendicular to the axial direction R. The raised surface portions 11*b*, 12*b* can be planar or curved and are adjacent in the present case to a mounting face 7, which is arranged perpendicular to the axial direction R as well, and onto which the retaining plate 3 can be screwed. The mounting surface 7 thus forms approximately the base side of the substantially triangle-shaped dirt collection chamber 71 between the rollers 2. In a borderline case, the dirt collection chamber 71 can be selected so large that the sliding bearing surfaces 11 and 12, together with the mounting surface 7, form one single planar surface.

Further design alternatives of the sliding bearing surfaces 11 and 12 or the dirt collection chamber 71, respectively, are also possible. The sliding bearing surfaces 11, 12, for example, can comprise a radius of curvature which is bigger than the radius of curvature of the roller 2, and a lateral fastening of the retaining plate 3 can be provided.

The bearing block 1 and the sliding bearing surfaces 11, 12 can be made of the same material as one piece, or a two-piece design with different materials can be provided. Because in the exemplary embodiment, the retaining plate 3 is screwed in axial direction R to the bearing block 1 by stud-bolts, thus even with a two-piece construction, a separate fastening of the sliding bearing surfaces can be abandoned.

Swiss Patent Reference CH-01571/08, filed 3 Oct. 2008, the priority document corresponding to this invention, to which a foreign priority benefit is claimed under Title 35, United States Code, Section 119, and its entire teachings are incorporated, by reference, into this specification.

What is claimed is:

1. A roller holder unit for a pressing tool with a piston-cylinder unit (50), in which clamping jaws (62) of a clamping pincer (60) are connected to a fork-like receiver (55) by a retaining bolt, the roller holder unit comprising:

rollers (2) that roll on the clamping jaws (62) of the clamping pincer (60), to move the clamping pincer (60) by the piston-cylinder unit (50), wherein a pressing is carried out by the clamping jaws (62) by a rear end being pressed apart by a movement of the rollers (2) in an axial direction R, a bearing block (1) including thereon at least one lateral retaining plate (3), the bearing block (1) including a sliding bearing surface (11, 12) for each of the rollers (2), securing pins (21) holding the rollers (2) to the retaining plate (3), the rollers (2) held freely rotatable by the securing pins (21) so that the rollers (2) at a periphery in a region between the securing pins (21) contact one another along a contact line (B), and a dirt collection chamber (71) in a region between contact surfaces of the rollers (2) with the sliding bearing surfaces (11, 12) and the contact line (B) of the two rollers (2).

2. The roller holder unit according to claim 1, wherein the dirt collection chamber (71) comprises lateral dirt discharge chambers (72) in a region near the contact surfaces.

3. The roller holder unit according to claim 1, wherein the dirt collection chamber (71) is large enough for the sliding bearing surfaces (11, 12) to form a continuous planar surface.

4. The roller holder unit according to claim 2, wherein the sliding bearing surfaces (11, 12) of the bearing block (1) each comprises one planar surface portion (11*a*, 12*a*) arranged perpendicular to a direction R, and one raised surface portion (11*b*, 12*b*).

5. The roller holder unit according to claim 2, wherein each of the sliding bearing surfaces (11, 12) of the bearing block (1) comprises a radius of curvature which is bigger than a second radius of curvature of each of the rollers (2).

6. The roller holder unit according to claim 5, wherein the retaining plate (3) is, in the axial direction R, screwed to the bearing block (1) by stud-bolts.

7. The roller holder unit according to claim 6, wherein the retaining plate (3) comprises a dirt scraper mounted on the retaining plate (3) on a side of the rollers (2) distant from the bearing block (1).

8. The roller holder unit according to claim 1, wherein the sliding bearing surfaces (11, 12) of the bearing block (1) each comprises one planar surface portion (11*a*, 12*a*) arranged perpendicular to a direction R, and one raised surface portion (11*b*, 12*b*).

9. The roller holder unit according to claim 1, wherein each of the sliding bearing surfaces (11, 12) of the bearing block (1) comprises a radius of curvature which is bigger than a second radius of curvature of each of the rollers (2).

10. The roller holder unit according to claim 1, wherein the retaining plate (3) is, in the axial direction R, screwed to the bearing block (1) by stud-bolts.

11. The roller holder unit according to claim 1, wherein the retaining plate (3) comprises a dirt scraper mounted on the retaining plate (3) on a side of the rollers (2) distant from the bearing block (1).

12. The roller holder unit according to claim 4, wherein the raised surface portion (11*b*, 12*b*) comprises a raised planar surface portion.

13. The roller holder unit according to claim 4, wherein the raised surface portion (11*b*, 12*b*) comprises a raised curved surface portion.

14. The roller holder unit according to claim 8, wherein the raised surface portion (11*b*, 12*b*) comprises a raised planar surface portion.

15. The roller holder unit according to claim 8, wherein the raised surface portion (11*b*, 12*b*) comprises a raised curved surface portion.

16. The roller holder unit according to claim 1, wherein the pressing tool is an electrically operated pressing tool.

17. The roller holder unit according to claim 1, wherein the pressing tool is an electro-hydraulically operated pressing tool.

18. The roller holder unit according to claim 1, wherein the pressing tool is a pneumatically-operated pressing tool.

* * * * *